US007338712B2

(12) United States Patent
Quinitilio

(10) Patent No.: US 7,338,712 B2
(45) Date of Patent: Mar. 4, 2008

(54) COATING COMPOSITION FOR A SMOOTHING AND/OR POLISHING ELEMENT AND A GRINDING WHEEL PROVIDED WITH SAID COATING COMPOSITION

(76) Inventor: Lupi Quinitilio, Via Flaminia 138, 00068 Rignano Flaminio (RM) (IT)

( * ) Notice: Subject to any disclaimer, the term of this patent is extended or adjusted under 35 U.S.C. 154(b) by 270 days.

(21) Appl. No.: 10/716,110

(22) Filed: Nov. 18, 2003

(65) Prior Publication Data

US 2006/0183818 A1 Aug. 17, 2006

Related U.S. Application Data

(63) Continuation-in-part of application No. 09/920,149, filed on Aug. 1, 2001, now abandoned.

(30) Foreign Application Priority Data

Aug. 4, 2000 (IT) ..... RM2000A0445

(51) Int. Cl.
*B32B 27/38* (2006.01)
*B32B 27/20* (2006.01)
*C08L 63/00* (2006.01)
*C08L 81/04* (2006.01)
*C08K 3/00* (2006.01)

(52) U.S. Cl. ..... 428/413; 523/400; 523/468; 525/523; 525/535

(58) Field of Classification Search ..... 428/413; 523/400, 440, 468; 525/523, 535
See application file for complete search history.

(56) References Cited

U.S. PATENT DOCUMENTS 4,016,857 A * 4/1977 Hall ..... 125/21

FOREIGN PATENT DOCUMENTS

EP 1177862 A2 * 2/2002

* cited by examiner

*Primary Examiner*—Michael J. Feely
(74) *Attorney, Agent, or Firm*—Gauthier & Connors LLP

(57) ABSTRACT

The invention concerns a coating for a smoothing and/or polishing element, particularly a flexible grinding wheel, provided with a flexible abrasive insert, for smoothing and polishing stone material, consisting essentially of: a blend of epoxy resin and polysulfide; a thixotrope; primary amines; and synthetic diamond treated by a polyvinyl-formal primer.

5 Claims, 2 Drawing Sheets

COATING COMPOSITION FOR A SMOOTHING AND/OR POLISHING ELEMENT AND A GRINDING WHEEL PROVIDED WITH SAID COATING COMPOSITION

This application is a continuation-in-part of U.S. Ser. No. 09/920,149, filed Aug. 1, 2001, now abandoned.

BACKGROUND OF THE INVENTION

1. Field of the Invention

The invention concerns a coating for a smoothing and/or polishing element, particularly a flexible grinding wheel, provided with a flexible abrasive insert, for smoothing and polishing stone material (marble, granite, sandstone, glass, ceramic, various agglomerates, and so on).

The invention further concerns a grinding wheel provided with a coating, a process for obtaining the same, as well as a process for realising the same.

2. Description of the Prior Art

At present, no solution exists in the abrasive field, as well as in the field of the relevant alloying elements, suitable to smooth the above materials, that allows one to obtain or use:

1) shaped grinding wheels for smoothing and polishing shaped profiles, frames, Greek key design, toroidal profiles;

2) grinding wheels for straight, cylindrical or rotative flat tool ribs;

3) plateau for polishing marble plates and similar;

4) rotative flat tools for polishing flat or convex ribs on marble and similar;

5) frankfurt sectors for band polishing machines;

6) cloths form or diapad sectors for flat or shaped surfaces, hand used of used by orbital honing machines; and 7) small plates, rotative flat tools or disks used with portable rotative or roto-orbital machines.

At present, the above mentioned tools are realised by the following technique, and employing, among the others, the following materials;

a) rigid binding grinding wheels with a rigid support;

b) magnesian binding with silicon carbide abrasive;

c) synthetic binding with silicon carbide abrasive;

d) synthetic binding with diamond abrasive;

e) resinoid binding with natural or synthetic diamond abrasive.

All the above raw materials have a rigid structure, so as they have to be moulded on a rigid support, not being consequently possible to guarantee the elasticity features that are nowadays necessary in most cases.

Another known technique is the one relevant to the grinding wheels with elastic rubber support, having elastic diamond cloths. By this kind of technique, a sufficiently flexible product is obtained, characterised by a rubber body having a diamond cloths insert, particularly used to work shaped profiles.

It is well known in the field that diamond cloths are cloths comprised of a textile base with an electrolytic or resinoid insert, having the diamond as abrasive element, with a thickness ranging from 0.6 and 1 mm, 0.5 tenths of which comprising the thickness of the cloth, the remainder being, as already said, comprised of an electrolytic or resinoid diamond spreading.

However, the above mentioned known techniques have some drawbacks, mainly when they are employed on shaped grinding wheels, destined to the working of toroidal shaped profiles, or of profiles having a different shape.

Problems encountered during the working can be individuated in the analyses of the various working phases providing a first step, in which a diamond grinding wheel comprised of a metallic body and insert with coarse grain sintered diamond treatment (usually 40/50 mesh), or electrodeposited, electrolytic (for marble) or with a sintered metallic binding (for granite), a second step employing a grinding wheel having the above features, but a more fine diamond granulometry, of about 170/200 mesh, that can vary according to the user choice.

The following steps provide the use of non-metallic grinding wheels.

The main problem faced is when the user works employing grinding wheels of the resinoid synthetic magnesian type.

Another kind of instrument presently used is comprised of shaped grinding wheels made up of synthetic or resinoid binding, with a traditional abrasive, such as silicon carbide and the like.

These grinding wheels, independently from the used abrasive, are characterised by a usually metallic inner insert, while the remaining parts are comprised of the above mentioned alloying elements materials.

The above problem is due to the incompatibility between these grinding wheels and the grinding wheel of the metallic type according to the previous working step.

In fact, it is very difficult to realise a profile exactly corresponding to the previous one, especially being within a few hundredths of a difference to have uniformity in polishing.

Thus, one is in the situation of working with resinoid synthetic grinding wheels in case of a deformed and scored profile, with the consequent unavoidable damaging of the same.

During the last few years, requests relevant to the shaped profiles are always becoming big problems, and present technologies do not allow to satisfy all the above requirements, as far as costs, time, finishing and polishing are concerned.

Summarising the above, synthetic and resinoid grinding wheels deforms and scores since they are comprised of soft alloying elements, grinding wheels having a rubber body with diamond cloths insert (gluing) do not deforms, but quickly destroy, since cloth, being subjected to an undue work, easily tears and unsticks from the body before having finished its standard wearing.

It is evident that cloths glued on a rubber body are a provisional solution in absence of a specific technology.

As far as the finishing is concerned, the user must retouch the profile by hand.

SUMMARY OF THE INVENTION

In view of the above, it is suggested according to the present invention a solution able to solve all the above mentioned problems.

Therefore a specific object of the present invention is to have a coating for a smoothing and/or polishing element, particularly a flexible grinding wheel, provided with a flexible abrasive insert, for smoothing and polishing stone material, including: between 34 and 52% by weight of a blend of epoxy resin and polysulfide; between 12 and 19% by weight of a thixotrope; between 9 and 18% by weight of primary amines; and synthetic diamond treated by a polyvinyl-formal primer.

The invention further concerns a grinding wheel comprising a coating as previously described.

A further object of the present invention is a process for coating a grinding wheel providing the following steps:

a) the diamond is mixed/immersed within a liquid product and it is dripped by a suitable sieve;

b) the above is mixed with a pre-mixed product comprising a thixotrope and a polyvinyl formal material;

c) the above is dried for about 4 hours;

d) the above is mixed, by a suitable mixer, with a blend of epoxy resin and polysulfide, a thixotrope, and primary amines;

e) the above is injected within a mould;

f) the mould is introduced along with the product within an oven for about 45" at the temperature of 90°;

g) the above is withdrawn from the oven and ground by the grinding wheel with a traditional system.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION OF THE INVENTION

Figure 1:
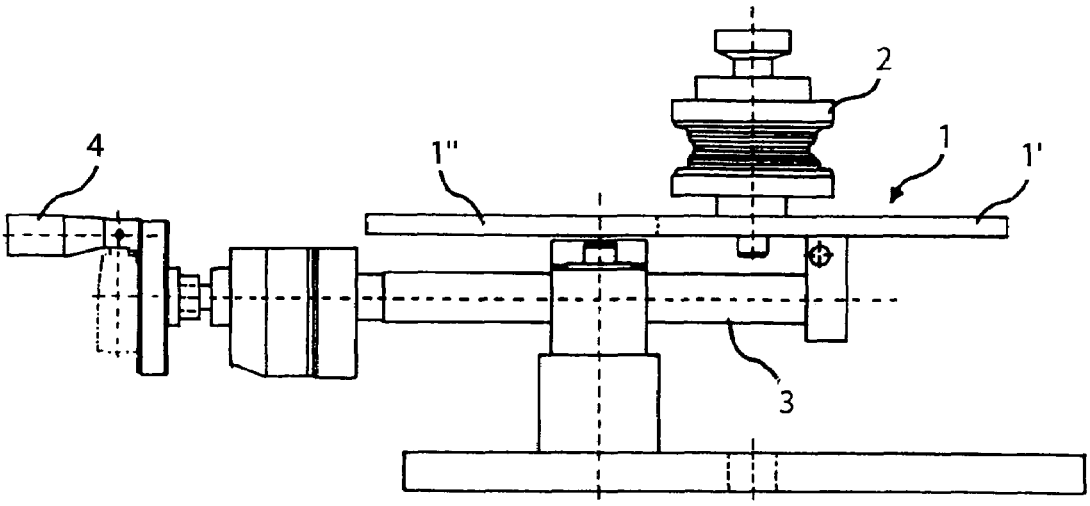
FIG. 1 is a front view of an apparatus to realise a grinding wheel according to the invention during a first working step.
Figure 2:
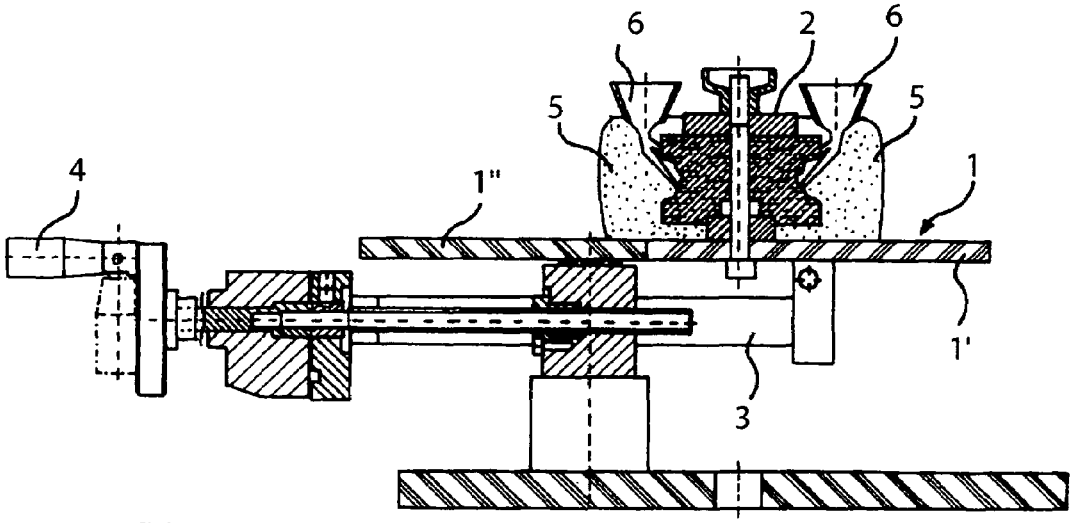
FIG. 2 is a section view of an apparatus to realise a grinding wheel according to the invention during a second working step.

Coming now to observe the figures of the enclosed drawings, it is shown an apparatus to manufacture a grinding wheel according to the invention.

The apparatus is one of the possible embodiments and does not constitute a limitation of the scope, since it is not an essential feature for the claimed object.

A grinding wheel 2, already having the desired shape, is provided on a plate 1, divided in two parts 1' and 1".

The plate 1 can be opened by the mechanism, generally indicated by the reference number 3, acting on the handle 4.

A temporary mould 5 is created about the grinding wheel 2, said mould 5 being provided with two channels 6 for casting the coating on the surface of the grinding wheel 2.

In this way, it is possible to realise profiles having any shape, without the need of making high investments to realise a definitive mould that would be used to make only few pieces. Obviously, in case it is necessary to make a mass production, it will be possible to make a definitive mould.

Figure 3:
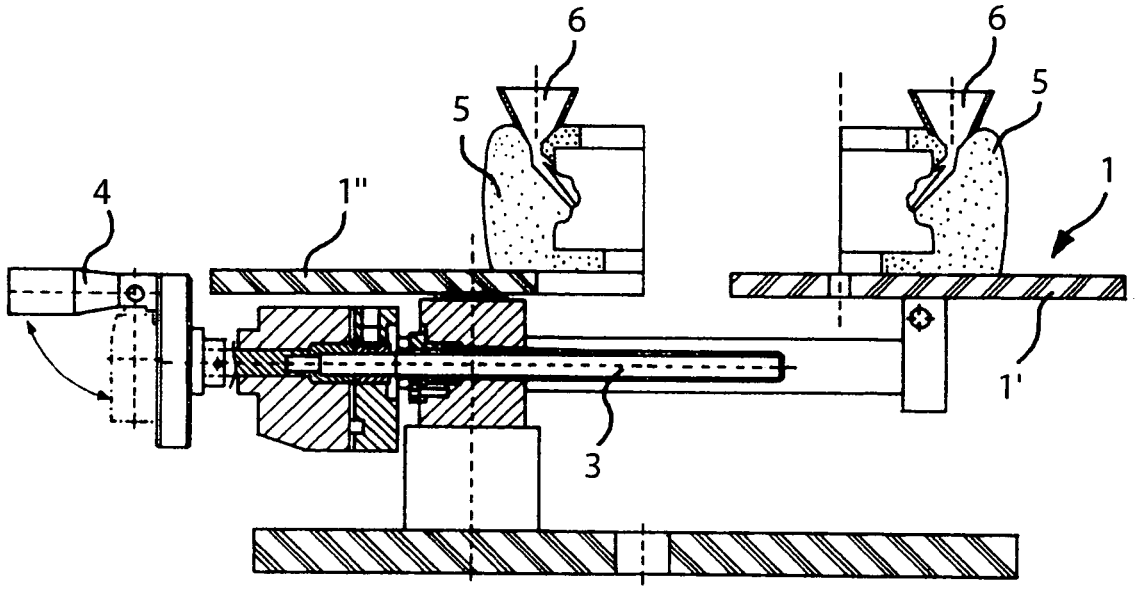
FIG. 3 is a section view of an apparatus to realise a grinding wheel according to the invention during a third working step.

Two hemi-plates, 1", along with the two hemi-parts of the mould 5, can be separated (FIG. 3) to remove the grinding wheel 2 along with the coating.

Therefore a coating for a smoothing and/or polishing element, particularly a flexible grinding wheel, provided with a flexible abrasive insert, for smoothing and polishing stone material, including: between 34 and 52% by weight of a blend of epoxy resin and polysulfide; between 12 and 19% by weight of a thixotrope; between 9 and 18% by weight of primary amines; and synthetic diamond treated by a polyvinyl-formal primer.

In a preferred embodiment, the coating has a thickness between 0.3 and 1.2 mm.

Preferably, the epoxy resins with poli-sulphuric polymers are present in a percentage of 45% by weight.

Particularly, the blend of epoxy resin and polysulfide can be comprised of TEXOS B210W®.

Preferably, said thixotrope is present in a percentage of 15% by weight.

Particularly, said thixotrope is comprised of CARBOSIL® comprising particulates of carbon and silica.

Preferably, said primary amines are present in percentage of 15% by weight.

Particularly, said primary amines are comprised of BYTHE 1226X®.

Preferably, said synthetic diamond, treated by a polyvinyl-formal primer, is present in a percentage of 25% by weight.

Particularly, said polyvinyl-formal primer is comprised of BRWY 21/B®.

A further object of the present invention is a process for coating a grinding wheel providing the following steps:

a) the diamond is mixed/immersed within a liquid product and it is dripped by a suitable sieve;

b) the above is mixed with a pre-mixed product comprising a thixotrope and a polyvinyl formal material;

c) the above is dried for about 4 hours;

d) the above is mixed, by a suitable mixer, with a blend of epoxy resin and polysulfide, a thixotrope, and primary amines;

e) the above is injected within a mould;

f) the mould is introduced along with the product within an oven for about 45" at the temperature of 90°;

g) the above is withdrawn from the oven and ground by the grinding wheel with a traditional system.

Preferably, said epoxy resins with poli-sulphuric polymers are provided in a percentage of 45% by weight.

Particularly, the blend of epoxy resin and polysulfide can be comprised of TEXOS B210W®.

Preferably, said thixotrope is present in a percentage of 15% by weight.

Particularly, said thixotrope is comprised of CARBOSIL® comprising particulates of carbon and silica.

Preferably, said primary amines are present in percentage of 15% by weight.

Particularly, said primary amines are comprised of BYTHE 1226X®.

Preferably, said synthetic diamond, treated by a polyvinyl-formal primer, is present in a percentage of 25% by weight.

Particularly, said polyvinyl-formal primer is comprised of BRWY 21/B®.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A coating composition for a smoothing and/or polishing element, particularly a flexible grinding wheel, provided with a flexible abrasive insert, for smoothing and polishing stone material, said coating composition consisting essentially of: a blend of epoxy resin and polysulfide; a thixotrope; primary amines; and synthetic diamond treated by a polyvinyl-formal primer.

2. A coated substrate comprising a substrate coated with the coating composition of claim 1, wherein the substrate is a grinding wheel.

3. The coated substrate according to claim 2, wherein the coating has a thickness between 0.3 and 1.2 mm.

4. The coated substrate according to claim 2, wherein the substrate is a flexible grinding wheel.

5. The coating composition according to claim 1, wherein the thixotrope comprises particulates of carbon and silica.

* * * * *